US005110704A

United States Patent [19]

Inoue et al.

[11] Patent Number: 5,110,704

[45] Date of Patent: May 5, 1992

[54] TONER FOR DEVELOPING STATICALLY CHARGED IMAGES AND PROCESS FOR PREPARATION THEREOF

[75] Inventors: Masahide Inoue, Nara; Tetsuya Nakano, Nabari; Naruo Yabe; Koichi Tsuyama, both of Kobe; Yoshitake Shimizu, Kyoto; Mitsushi Kuroki, Kumamoto, all of Japan

[73] Assignee: Mita Industrial Co., Ltd., Osaka, Japan

[21] Appl. No.: 544,632

[22] Filed: Jun. 27, 1990

[30] Foreign Application Priority Data

Jun. 29, 1989 [JP] Japan ..... 1-165346

[51] Int. Cl.[5] ..... G03G 9/087; G03G 9/097

[52] U.S. Cl. ..... 430/110; 430/109; 430/111

[58] Field of Search ..... 430/109, 110, 111

[56] References Cited

U.S. PATENT DOCUMENTS 4,806,635 2/1989 Chupka ..... 430/109

4,913,991 4/1990 Chiba et al. ..... 430/99 X

*Primary Examiner*—Roland Martin

*Attorney, Agent, or Firm*—Sherman and Shalloway

[57] ABSTRACT

Disclosed is a toner for developing a statically charged image, which comprises a fixing resin and, dispersed therein, a colorant and a charge-controlling dye. This toner is characterized in that the tangent (tan δ) of the loss angle is in the range of from 0.95 to 1.25 when the storage modulus of elasticity (G') is $10^4$ dyne/cm$^2$. The toner having such rheological characteristics has an excellent fixing property, a high offset resistance, a capacity of forming an image having a high quality and a good durability.

10 Claims, No Drawings

TONER FOR DEVELOPING STATICALLY CHARGED IMAGES AND PROCESS FOR PREPARATION THEREOF

BACKGROUND OF THE INVENTION (1) Field of the Invention

The present invention relates to a toner for developing a statically charged image and a process for the preparation thereof. More particularly, the present invention relates to a toner for developing a statically charged image, which has a good fixing property, a high offset resistance, a property of forming an image having a high quality and a good durability in combination, and a process for the preparation of this toner.

(2) Description of the Related Art

In commercial electrophotography, there is adopted an image-forming system in which a statically charged image is formed on a photosensitive material, the statically charged image is developed with a charged toner, the formed toner image is transferred onto a copy sheet or the like and the transferred toner image is thermally fixed. In view of the operation facility and safety, a method of passing a copying sheet carrying a toner image thereon through a heating roll is generally adopted for effecting the heat fixation. However, in this case, the problem of offsetting of the toner on the roll surface arises during heat fixation.

Many means for preventing this offsetting phenomenon have been proposed. For example, there is generally adopted a method in which an offset-preventing liquid is applied onto the roll or a release agent is incorporated into the toner.

Furthermore, many methods for preventing the offset by adjusting the molecular weight or viscoelastic (rheological) characteristics of the fixing resin in the toner have been proposed. For example, Japanese Unexamined Patent Publication No. 56-16144 teaches use of a fixing resin having one maximum value in a molecular weight range of $10^3$ to $8\times10^4$ and one maximum value in a molecular weight range of $10^5$ to $2\times10^6$ in the gel permeation chromatography (GPC), and Japanese Unexamined Patent Publication No. 59-214860 teaches that a thermoplastic resin in which the real part (storage modulus of elasticity) of the complex modulus of the elasticity is $5\times10^4$ to $5\times10^6$ Pa and the imaginary part (loss modulus of elasticity) is $5\times10^4$ to $2\times10^6$ Pa is used as the fixing resin.

According to the former proposal, it is taught that the low-molecular-weight component drops the lower limit of the fixing temperature and the high-molecular-weight component exerts the function of giving an offset resistance. However, if the amount of the low-molecular-weight component is too small, it is difficult to sufficiently drop the lower limit of the fixing temperature, and if the amount of the high-molecular-weight component is too large, the offset resistance is degraded. Accordingly, it is difficult to keep a good balance between the amounts of the two components, and satisfactory results cannot be obtained. The latter proposal is significant and interesting in that the storage modulus and loss modulus of elasticity of the resin are noted, but no strict correspondence relation is present between these factors and the actual fixing property or offset resistance.

These proposals relate to selection of a fixing resin to be used. However, in the case where the practical toner is evaluated, even if the resin reaches the selection standard, the fixing temperature range or the frequency of occurrence of the offset varies widely according to the dispersion state of the pigment or charge-controlling dye, and no satisfactory results can be obtained.

SUMMARY OF THE INVENTION

It is therefore a primary object of the present invention to provide a toner for developing a statically charged image, which shows an excellent adhesive force of the melted toner to a transfer material and an excellent resistance to offsetting to a fixing roller in combination, having a broad fixing temperature range and an excellent fixing property and also having a capacity of forming an image having a high quality.

Another object of the present invention is to provide a process for the preparation of this toner.

In accordance with one aspect of the present invention, there is provided a toner for developing a statically charged image, which comprises a fixing resin and, dispersed therein, a colorant and a charge-controlling dye, wherein the composition has such rheological characteristics that the tangent (tan $\delta$) of the loss angle is 0.95 to 1.25 when the storage modules of elasticity (G') is $10^4$ dyne/cm$^2$.

In the toner of the present invention, it is preferred that the surface dye concentration/entire dye concentration ratio in the toner be in the range of from 0.30 to 0.50.

In accordance with another aspect of the present invention, there is provided a process for the preparation of a toner for developing a statically charged image, which comprises combining a fixing resin, a colorant and a charge-controlling dye so that the tangent (tan $\delta$) of the loss angle is 0.95 to 1.25 when the storage modulus of elasticity (G') is $10^4$ dyne/cm$^2$.

DETAILED DESCRIPTION OF THE PREFERRED EMBODIMENTS

We found that phenomena caused at the heating roller fixation of a toner for developing a statically charged image do not correspond strictly to the molecular weight distribution of the fixing resin or the rheological characteristics such as the storage modulus of elasticity and the loss modulus of elasticity but depend not only on the fixing resin but also on the incorporated colorant and charge-controlling agent and the dispersion state thereof, and therefore, the above phenomena depend rather on the rheological characteristics of the actual toner composition.

More specifically, the first characteristic of the toner for developing a statically charged image according to the present invention is that the toner-constituting composition has such rheological characteristics that the tangent (tan $\delta$) of the loss angle is 0.95 to 1.25, especially 1.05 to 1.15, when the storage modulus of elasticity (G') is $10^4$ dyne/cm$^2$.

The tangent (tan $\delta$) of the loss angle is represented by the ratio of the loss modulus of elasticity (G'') to the storage modulus of elasticity (G'), and these values are determined according to the method described below.

A toner is formed into a sheet having a square shape of 20 mm$\times$20 mm and a thickness of 2 mm by a hot press, and the obtained sample is maintained at a predetermined temperature by using Rheospector DVE supplied by Rheology Co. as the measuring apparatus, a tangential vibration (measurement frequency=1 Hz) is applied in the shearing direction by the forced vibration non-resonance method, the stress response is measured under an ultra-minute displacement, and the storage modulus (G') of elasticity, the loss modulus of elasticity and the tangent (tan δ) of the loss angle are calculated from its power and dynamic strain according to the known calculation method.

The reason why the rheological characteristics of the toner composition are not defined by the values of the storage modulus of elasticity (G') and the loss modulus of elasticity (G'') but by the tangent (tan δ) of the loss angle which is the ratio between the two values is that the storage modulus of elasticity (G') has a relation to the cohesive force of the composition while the loss modulus of elasticity (G'') has a relation to the viscosity of the composition, and the fixing property and offset property of the toner on the transfer material at the time of contact with the fixing roller are influenced by the balance between the two values. More specifically, as the loss modulus of elasticity increases, the viscosity decreases and also the fixing property of the toner increases. In contrast, as the storage modulus of elasticity increases, the cohesive force increases and the offset property decreases, and also the fixing property decreases. Accordingly, it is understood that a certain preferable range is present for the ratio between the two values. The reason why the value of the tangent (tan δ) of the loss angle is defined based on the storage modulus (G') of elasticity of $10^4$ dyne/cm$^2$ ($10^3$ Pa) is that although it has been considered that if the storage modulus of elasticity is as low as mentioned above, the cohesive force is too small and the offsetting phenomenon is caused. In the present invention it is intended that generation of the offset is prevented even under such a strict condition.

If the value of tan δ of the toner composition is below this range, the adhesion or intrusion of the melted toner into the transfer material is insufficient and the problem of insufficient fixation is often caused. If the value of tan δ exceeds the above-mentioned range, because of insufficient cohesion of the melted toner, a part of the toner is transferred onto the heating roller to cause the offset. According to the present invention, by adjusting tan δ of the toner composition within the above-mentioned range, an excellent fixing property and a high offset resistance can be obtained in combination. Furthermore, even if the storage modulus of elasticity (G') is extremely low, a high offset resistance can be obtained, and therefore, the fixing temperature range, that is, the range of from the lower limit of the fixing-causing temperature to the lower limit of the offset-causing temperature, can be greatly expanded over this range in the conventional toners. Moreover, in the toner of the present invention, since the range of tan δ is relatively narrow, excellent storage stability and flowability can be attained, and the toner of the present invention is advantageous in that since the fixed toner image has a reduced gloss, the image is easy to read.

The toner of the present invention is additionally characterized in that the surface dye concentration/entire dye concentration ratio is controlled within a certain range of 0.30 to 0.50, especially 0.35 to 0.45. By the entire dye concentration is meant the concentration of the dye contained in the entire toner particles, and by the surface dye concentration is meant the concentration of the dye present only on the surface of the toner particles. Accordingly, if this concentration ratio is 1, this means that all of the dye is present only on the surface of the toner particles, and if this concentration ratio is zero, this means that the dye is not present on the surface of the toner particles at all. As described in detail hereinafter, the dye concentration ratio depends on the degree of kneading of the toner composition.

If the dye concentration ratio is below the above-mentioned range, the image density tends to decrease. It is considered that the reason is that the electric resistance becomes too high. If the dye concentration ratio exceeds the above-mentioned range, occurrence of the offset is more conspicuous than when the dye concentration ratio is within the above-mentioned range. The reason is considered to be that the dye present on the surface of the particles comes to have an increased affinity with the fixing roller or is readily attracted electrostatically to the fixing roller.

In the present invention, in order to adjust tan δ of the toner composition within the above-mentioned range, it is necessary to select appropriate toner components and adjust the degree of dispersion thereof.

In the first place, use of a styrene/acrylic copolymer having at least two peaks in the molecular weight distribution by GPC is preferable. In this copolymer, it is preferred that the peak in the low-molecular-weight region be less than $13\times10^3$, especially in the range of from $5\times10^3$ to $7\times10^3$, and the peak in the high-molecular-weight region be at least $1.5\times10^5$. It also is preferred that in the molecular weight distribution by GPC, the ratio of the peak area on the low-molecular-weight side to the peak area on the high-molecular-weight range be from 2/1 to 4/1.

The ratio between styrene and the acrylic monomer in the copolymer can be changed in a broad range, but it is preferred that the molar ratio between them be from 60/40 to 98/2, especially from 75/25 to 85/15. As the acrylic monomer, there can be mentioned alkyl (meth)acrylates such as methyl (meth)acrylate, ethyl (meth)acrylate, propyl (meth)acrylate, butyl (meth)acrylate and 2-ethylhexyl (meth)actrlate, acrylic acid and methacrylic acid, (meth)acrylonitrile, (meth)acrylamide, (meth)acrylhydroxyalkyl esters such as (meth)acryl-2-hydroxyethyl and (meth)acryl-3-hydroxypropyl, (meth)acrylaminoalkyl esters such as (meth)acryl-2-aminoethyl, (meth)acryl-3-aminopropyl and N-ethyl(meth)acryl-2-aminoethyl, and glycidyl (meth)acrylate. Preferably, the acrylic monomer is composed mainly of an alkyl (meth)acrylate. A styrene/acrylic copolymer comprising 75 to 85% by weight of styrene, 0.5 to 5% by weight of methyl methacrylate and 10 to 20% by weight of n-butyl acrylate is especially preferably used.

The charge-controlling dye used in the present invention is preferably a metal-containing complex salt dye and especially preferably a 2:1 type metal-containing complex salt dye (dye molecular/metal molar ratio=2/1). This metal-containing complex salt dye can be represented by the following formula:

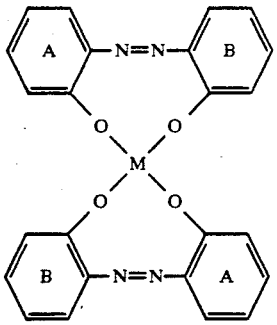

wherein rings A and B can have a fused ring and can have a substituent such as a halogen atom, a nitro group, an alkyl group or an amide group, and M represents a transition metal.

As the transition metal, there can be mentioned Cr. Co, Cu, Fe and Ni. A dye containing Cr is preferably used.

At least one member selected from the group consisting of coloring pigments, extender pigments, magnetic pigments and electroconductive pigments can be used as the colorant. Of course, a pigment having two or more of the above functions can be used. For example, carbon black acts not only as a black pigment but also as an electroconductive pigment, and triiron tetroxide acts not only as a magnetic pigment but also as a black pigment as is apparent from its common name of black iron.

Suitable examples of the coloring pigment are as follows.

Black Pigments

Carbon black, acetylene black, lamp black and aniline black.

Yellow Pigments

Chrome yellow, zinc yellow, cadmium yellow, yellow iron oxide, Mineral Fast Yellow, nickel titanium yellow, naples yellow, Naphthol Yellow, Hansa Yellow G, Hansa Yellow 10 G, Benzidine Yellow G, Benzidine Yellow GR, Quinoline Yellow Lake and Permanent Yellow NCG.

Orange Pigments

Chrome orange, molybdenum orange, Permanent Orange GTR, Pyrazolone Orange, Vulcan Orange, Indanthrene Brilliant Orange RK, Benzidine Orange G and Indanthrene Brilliant Orange GK.

Red Pigments

Red iron oxide, cadmium red, red lead, cadmium mercury sulfide, Permanent Red 4R, Lithol Red, Pyrazolone Red, Watchung Red calcium salt, Lake Red D, Brilliant Carmine 6B, Eosine Lake, Rhodamine Lake B, Alizarin Lake and Brilliant Carmine 3B.

Violet Pigments

Manganese violet, Fast Violet B and Methyl Violet Lake.

Blue Pigments

Prussian blue, cobalt blue, Alkali Blue Lake, Victoria Blue Lake, Phthalocyanine Blue, metal-free Phthalocyanine Blue, partially chlorinated Phthalocyanine Blue, Fast Sky Blue and Indanthrene Blue BC.

Green Pigments

Chrome green, chromium oxide, Pigment Green B, Malachite Green Lake and Fanal Yellow Green G.

White Pigments

Zinc flower, titanium oxide, antimony white and zinc sulfide.

Baryte powder, barium carbonate, clay, silica, white carbon, talc and alumina white.

As the magnetic pigment, there are known triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). In the present invention, any of fine powders of these known magnetic materials can be used. Triiron tetroxide is especially preferably used as the magnetic pigment for attaining the objects of the present invention.

As the electroconductive pigment, not only above-mentioned carbon black but also inorganic powders which are inherently electrically non-conductive but are subjected to the electrically conducting treatment can be used, and furthermore, various metal powders can be used.

The amounts of these toner components are preferably selected so that the amount of the fixing resin be 80 to 96% by weight, especially 85 to 93% by weight, based on the three components, the amount of the charge-controlling dye be 0.2 to 5% by weight, especially 0.5 to 2% by weight, based on the three components, and the amount of the colorant or pigment may be 2 to 12% by weight, especially 3 to 10% by weight, based on the three components.

Other known toner additives, for example, release agents such as polyethylene wax and polypropylene wax, can be incorporated according to known recipes.

The above-mentioned toner components are preliminarily mixed by a mixer such as a Henschel mixer and then kneaded by a kneading device such as a twin-screw extruder. The kneaded composition is cooled, pulverized and classified to obtain a toner.

As pointed out hereinbefore, tan $\delta$ of the toner composition varies according to the degree of the kneading. In general, as the toner composition is sufficiently kneaded and the dispersed particle size of the dye and pigment are reduced, the value of tan $\delta$ tends to decrease. Namely, the storage modulus of elasticity tends to increase and the loss modulus of elasticity tends to decrease. Accordingly, it is understood that it is important to perform preliminary mixing of the toner components sufficiently and use a twin-screw extruder exerting a high kneading effect.

The particle size of the toner is preferably such that the median diameter measured by Coulter Counter is 5 to 20 $\mu$m, especially 7 to 15 $\mu$m.

In the electrostatic photography using the toner of the present invention, formation of an electrostatic latent image can be performed according to an optional known process. For example, an electrostatic latent image can be formed by uniformly charging a photoconductive layer on an electroconductive substrate and exposing the charged photoconductive layer imagewise to light.

For the development of the statically charged image, in case of a one-component type magnetic toner, the toner is directly used or in case of a two-component type developer, the toner is mixed with a magnetic carrier, and a magnetic brush of the toner is brought into contact with the photoconductive layer on the substrate, whereby the development can be easily accomplished. The toner image formed by the development is transferred onto a copy sheet and is fixed by contact with a heating roll.

According to the present invention, by using a toner composition having such rheological characteristics that the tangent (tan δ) of the loss angle is 0.95 to 1.25 when the storage modulus of elasticity (G') is $10^4$ dyne/cm$^2$, there can be provided a toner for developing a statically charged image, which is excellent in the combination of the adhesive force of the melted toner to a transfer material and the resistance against offsetting to a fixing roller, and which has a broad fixing temperature range, an excellent fixing property and a capacity of forming an image having a high quality.

The present invention will now be described in detail with reference to the following examples and comparative examples that by no means limit the scope of the invention.

EXAMPLE 1

In order to obtain a toner composition satisfying the requirement of the tangent (tan δ) of the loss angle specified in the present invention, 100 parts by weight of a styrene/acrylic copolymer having peaks in ranges of from $5\times10^3$ to $7\times10^3$ and from 1.5 to $10^5$ to 2.0 to $10^5$ in the molecular weight distribution by GPC and comprising 75 to 85% by weight of styrene, 0.5 to 5% by weight of methyl methacrylate and 10 to 20% by weight of n-butyl acrylate, in which the ratio of the peak area of the low-molecular-weight region to the peak area of the high-molecular-weight region in the molecular weight distribution by GPC was 3/1, was mixed for 30 minutes with 10 parts by weight of carbon black as the colorant, 1.5 parts by weight of an azo type chromium complex salt dye as the charge-controlling agent and 1.5 parts by weight of low-molecular-weight polypropylene as the release agent by using a Henschel mixer. Then, the composition was kneaded by a three-roll mill, and the kneaded composition was cooled, pulverized and classified to obtain a toner of the present invention having a volume average particle size of 11 μm.

The tangent (tan δ) of the loss angle was measured when the storage modulus of elasticity (G') was $10^4$ dyne/cm$^2$. It was found that this tangent (tan δ) of the obtained toner was 1.05.

Then, 500 ml of methanol was added to precisely weighed 100 mg of the toner, and the mixture was treated by a ball mill for 10 minutes and allowed to stand still for 1 day. The dye concentration of the supernatant was measured by an absorptiometer, and the surface dye concentration (g/g) was calculated according to Lambert-Beer's law. It was found that the surface dye concentration/entire dye concentration ratio was 0.39.

A developer was prepared by mixing 5 parts by weight of the toner with 95 parts by weight of a ferrite carrier having an average particle size of 90 μm, and the copying test was carried out by using this developer in a commercially available electrophotographic copying machine (Model DC-2055 supplied by Mita Kogyo) to obtain 10,000 copies. Offset was not caused in any of these 10,000 copies and the fixing roller was not contaminated at all, and high-quality images having a fixing ratio higher than 90% were obtained. In the 10,000th copy, the resolution was 6.3 lines/mm, the image density was 1.39 and the fog density was 0.001.

EXAMPLE 2

By using a Henschel mixer, 100 parts by weight of the same styrene/acrylic copolymer as used in Example 1 was mixed with 8.5 parts by weight of carbon black as the colorant, 1.0 part by weight of an azo type chromium complex salt dye as the charge-controlling agent and 2.0 parts by weight of low-molecular-weight polypropylene as the release agent for 5 minutes, and the mixture was kneaded by a three-roll mill and the kneaded composition was cooled, pulverized and classified to obtain a toner of the present invention having a volume average particle size of 10.5 μm.

The tangent (tan δ) of the loss angle of this toner measured when the storage modulus of elasticity (G') was $10^4$ dyne/cm$^2$ was 1.20. The surface dye concentration/entire dye concentration ratio was 0.62.

In the same manner as described in Example 1, the copying test was carried out in DC-2055 to obtain 10,000 copies. Fixed images having a fixing ratio higher than 90% were obtained in all of 10,000 copies, and offset was not caused at all. It was found that the fixing roller was slightly contaminated. In the 10,000th copy, the resolution was 6.3 lines/mm, the image density was 1.40 and the fog density was 0.002.

EXAMPLE 3

The mixing treatment was carried out for 20 minutes by a Henschel mixer according to the same recipe as adopted in Example 1 except that 100 parts by weight of a styrene/acrylic copolymer having peaks between $7\times10^3$ and $9\times10^3$ and between $3\times10^5$ and $5\times10^5$ in the molecular weight distribution by GPC and comprising 75 to 85% by weight of styrene and 15 to 25% by weight of butyl acrylate, in which the ratio of the peak area of the low-molecular-weight region to the peak area of the high-molecular-weight region in the molecular weight distribution by GPC was 2/1, was used instead of the copolymer used in Example 1. The mixture was mixed by using a three-roll mill and the kneaded composition was cooled, pulverized and classified to obtain a toner of the present invention having a volume average molecular weight of 11 μm.

The tangent (tan δ) of the loss angle of the toner measured when the storage modulus of elasticity (G') was $10^4$ dyne/cm$^2$ was 1.22, and the surface dye concentration/entire dye concentration ratio was 0.40.

The copying test was carried out in DC-2055 in the same manner as described in Example 1 to obtain 10,000 copies. Fixed images having a fixing ratio higher than 90% were obtained without occurrence of offset. The fixing roller was slightly contaminated. In the 10,000th copy, the resolution was 5.6 lines/mm, the image density was 1.39 and the fog density was 0.003.

Comparative Example 1

By using a Henschel mixer, 100 parts by weight of a styrene/acrylic copolymer having one peak between $1\times10^3$ and $2\times10^7$ in the molecular weight distribution by GPC and a weight average molecular weight of 225,000 and comprising 75 to 85% by weight of styrene and 15 to 25% by weight of butyl acrylate was mixed for 10 minutes with 7.5 parts by weight of carbon black as the colorant, 2.0 parts by weight of an azo type chromium complex salt dye as the charge-controlling agent and 1.0 part by weight of low-molecular-weight polypropylene. The mixture was kneaded by a three-roll mill and the kneaded composition was cooled, pulverized and classified to obtain a toner having an average particle size of 10.5 μm. The tangent (tan δ) of the low angle of the toner measured when the storage modulus of elasticity (G') was $10^4$ dyne/cm$^2$ was 1.31. The surface dye concentration/entire dye concentration ratio was 0.51.

The copying test was carried out in the same manner as described in Example 1 to obtain 10,000 copies. The fixing ratio in the fixed images was maintained at a level higher than 90%, but offset was frequently caused and the contamination of the fixing roller was conspicuous. In the 10,000th copy, the resolution was 5.0 lines/mm, the image density was 1.38 and the fog density was 0.005.

COMPARATIVE EXAMPLE 2

The mixing treatment was carried out for 40 minutes by a Henschel mixer according to the same recipe as adopted in Comparative Example 1 except that the amount of carbon black was changed to 10 parts by weight and the amount of the charge-controlling agent was changed to 1.0 part by weight. The mixture was kneaded by a three-roll mill and the kneaded composition was cooled, pulverized and classified to obtain a toner having a volume average particle of 11.5 μm. The tangent (tan δ) of the loss angle of the toner measured when the storage modulus of elasticity (G') was $10^4$ dyne/cm$^2$ was 0.90, and the surface dye concentration-/entire dye concentration ratio was 0.375.

The copying test was carried out in the same manner as described in Example 1 to obtain 10,000 copies. Offset was not caused, but the fixing ratio was lower than 90% and was about 80%. In the 10,000th copy, the resolution was 5.0 lines/mm, the image density was 1.40 and the fog density was 0.003.

COMPARATIVE EXAMPLE 3

By a Henschel mixer, 100 parts by weight of the same styrene/acrylic copolymer as used in Example 3 was mixed for 5 minutes with 12 parts by weight of carbon black, 3.0 parts by weight of an azo type chromium complex salt as the charge-controlling agent and 1.5 parts by weight of low-molecular-weight polypropylene as the release agent. The mixture was kneaded by a three-roll mill and the kneaded composition was cooled, pulverized and classified to obtain a toner having an average particle size of 11 μm. The tangent (tan δ) of the loss angle of the toner measured when the storage modulus of elasticity (G') was $10^4$ dyne/cm$^2$ was 1.35. The surface dye concentration/entire dye concentration ratio was 0.65.

In the same manner as described in Example 1, the copying test was carried out to obtain 10,000 copies. The fixing ratio was almost 90%, but offset was frequently caused and the contamination of the fixing roller was conspicuous. In the 10,000th copy, the resolution was 5.0 lines/mm, the image density was 1.39 and the fog density was 0.005.

With respect to each of the toners, obtained in the foregoing examples and comparative examples, in a remodeled machine of DC-2055 of the heating press roll fixation type, the set temperature of the heating roller was elevated stepwise at intervals of 5° C. from 150° C. and the offset-generating temperature was examined. It was found that the offset-generating temperatures of the toners obtained in Examples 1, 2 and 3 were 195° C., 190° C. and 190° C., respectively, and the offset-generating temperatures of the tones obtained in Comparative Examples 1, 2 and 3 were 165° C., 180° C. and 165° C., respectively.

We claim:

1. A toner for developing a statically charged image, which comprises particles containing a fixing resin and, dispersed therein, a colorant and a charge-controlling dye, wherein the composition has such rheological characteristics that the tangent (tan δ) of the loss angle is 0.95 to 1.25 when the storage modulus of elasticity (G') is $10^4$ dyne/cm$^2$ and wherein the ratio of concentration of dye on the surface of the particles to total dye concentration of the toner is in the range of from 0.30 to 0.50.

2. The toner as set forth in claim 1, wherein the fixing resin has at least two peaks in the molecular weight distribution determined by gel permeation chromagraphy, the peak in the low-molecular-weight region is less than $13\times10^3$ and the peak in the high-molecular weight region is at least $1.5\times10^5$, and the ratio of the peak area on the low-molecular-weight side to the peak area on the high-molecular-weight side is in the range of from 2/1 to 4/1.

3. The toner as set forth in any of claims 1 through 2, wherein the fixing resin is a styrene/acrylic copolymer in which the styrene component/acrylic component molar ratio is from 60/40 to 98/2.

4. The toner as set forth in any of claims 1 through 3, wherein the charge-controlling dye is a metal-containing complex salt dye in which the dye molecule/metal molar ratio is 2/1.

5. The toner as set forth in any of claims 1 through 4, which further comprises a release agent.

6. The toner as set forth in claim 1 wherein the ratio of concentration of dye on the surface of the toner particles to total dye concentration of is in the range of from 0.35 to 0.45.

7. The toner as set forth in claim 3 wherein the styrene component/acrylic component molar ratio is from 75/25 to 85/15.

8. The toner as set forth in claim 4 wherein the charge-controlling dye is a chromium containing complex salt dye.

9. The toner as set forth in claim 1 wherein the particle size of the toner is in the range of 5 to 20 μm.

10. The toner as set forth in claim 1 wherein the amount of fixing resin is 85 to 93 wt %, the amount of charge-controlling dye is 0.5 to 2 wt % and the amount of colorant is 3 to 10 wt % based on the combined weight of the three components.

* * * * *